United States Patent [19]

Bailey et al.

[11] 4,354,900

[45] Oct. 19, 1982

[54] STRENGTHENED FIBEROUS ELECTROCHEMICAL CELL DIAPHRAGM AND A METHOD FOR MAKING

[75] Inventors: Rodney R. Bailey, Greenville, S.C.; Carl W. Brown, Painesville, Ohio; Shan P. Tsai, Mentor, Ohio; Louis W. Hruska, Geneva, Ohio

[73] Assignee: Diamond Shamrock Corporation, Dallas, Tex.

[21] Appl. No.: 211,694

[22] Filed: Dec. 1, 1980

[51] Int. Cl.[3] ..... C25B 13/00

[52] U.S. Cl. ..... 162/106; 162/152; 162/153; 162/181.4; 204/295

[58] Field of Search ..... 162/106, 153, 105, 152, 162/181.4; 204/295, 296

[56] References Cited

U.S. PATENT DOCUMENTS

| | | | |
|---|---|---|---|
| 1,863,070 | 6/1932 | Shönfeldt et al. | 204/295 |
| 3,497,389 | 2/1970 | Berger et al. . | |
| 3,497,394 | 2/1970 | Berger . | |
| 4,170,537 | 10/1979 | Simmons . | |
| 4,170,538 | 10/1979 | Simmons . | |
| 4,170,539 | 10/1979 | Simmons . | |
| 4,180,449 | 12/1979 | Heikel . | |
| 4,207,163 | 6/1980 | Kadija . | |
| 4,207,164 | 6/1980 | Kadija . | |
| 4,253,935 | 3/1981 | Simmons | 204/295 |

FOREIGN PATENT DOCUMENTS

| | | |
|---|---|---|
| 594897 | 5/1960 | Canada . |
| 1385394 | 3/1975 | United Kingdom . |

OTHER PUBLICATIONS

"Zirconium Compounds In Textile Waterproofing", Magnesium Elektron Ltd.

"Zirconium in the Cross-Linking of Polymers", Warren Blumenthal, *Rubber World* 56, (Jan., 1967).

22 *Encyclopedia of Chemical Technology* 639 (1970).

*Primary Examiner*—Peter Chin

*Attorney, Agent, or Firm*—John P. Hazzard; Woodrow W. Ban

[57] ABSTRACT

A strengthened fiber diaphragm and method for making such a diaphragm for use in electrochemical cells, the strengthening being accomplished through solution introduction of a zirconium compound into the fabric of the diaphragm.

15 Claims, No Drawings

STRENGTHENED FIBEROUS ELECTROCHEMICAL CELL DIAPHRAGM AND A METHOD FOR MAKING

TECHNICAL FIELD

This invention relates to cells for the electrolytic processing of chemicals. More specifically, this invention relates to separators or diaphragms utilized in these cells to separate anode and cathode compartments. Particularly, this invention relates to sturdy, long-lived diaphragms and a method for their making for use in such cells in the production of, for example, chlorine gas.

BACKGROUND OF THE INVENTION

Diaphragms are frequently utilized in electrochemical cells to partition the cell into separate compartments. Typically, one of these compartments will house an anodic cell electrode or anode, and the other compartment will house a cathodic cell electrode or cathode.

Cell liquid containing a dissolved salt to be electrolytically disassociated is introduced into one of the compartments. An electrical potential is impressed between the anode and cathode, and this potential induces an electrical current between the electrodes. Under impetus of this electrical current, anions of the electrolyte migrate to the anode while electrolyte cations migrate to the cathode.

Where electrolyte is introduced into only one compartment, one of the ions must necessarily cross the diaphragm. Some nondisassociated components of the cell liquid normally cross the diaphragm as well.

In many cells, at least one of the ions reacts at the appropriate electrode to produce a gas that leaves the cell. Often, however, at least one of the ions reacts to form a desired chemical product soluble in the cell liquid. Often it is advantageous to concentrate this desired product for recovery.

One method of concentration is to require the ion reacting to form the soluble product to migrate, along with some of the cell liquid, through the diaphragm to the other compartment where additional reactants may be added. When this method is used, a hydraulic head is maintained in the compartment into which cell liquid is first introduced. This hydraulic head, liquid level somewhat greater than in the second compartment, promotes primarily one-way fluid movement through the diaphragm. Ions negotiating the diaphragm to react and form the desired chemical product are encouraged by one-way fluid movement fostered by the hydraulic head. Migration of the desired soluble chemical product through the diaphragm from the second compartment to the first is discouraged by the hydraulic head.

Further in some applications, the desired soluble chemical product can participate in additional and dysfunctional cell reactions if permitted to transverse the diaphragm and approach the other electrode. In these applications, division of the cell utilizing a diaphragm produces a double bonus of both concentrating the desired chemical product in a portion of the cell liquid and reducing competing cell reactions.

A typical example of such an electrochemical cell is found in the electrochemical production of chlorine. In one type of commercial chlorine process, a cell liquid or brine is formed by dissolving an alkali metal salt such as NaCl or KCl in water. The brine is introduced into the anode compartment of a suitable electrochemical cell having compartments defined by a partitioning diaphragm. When a voltage potential is impressed on the cell, anionic chlorine migrates to the anode under the impetus of the electrical potential, reacts to form chlorine gas and the gas then exits the cell by bubbling up through the cell liquid and into a collection apparatus. Alkali metal cations, normally sodium, migrate along with the cell liquid through the diaphragm to the cathode compartment and react with hydroxyl ions resulting from water decomposition at the cathode to form sodium hydroxide or caustic. The caustic is a desired chemical product soluble in the cell liquid. Hydrogen gas is also formed during this cathode reaction, and the hydrogen bubbles to the surface of the cell liquid in the cathode compartment and its captured.

The caustic generally remains dissolved in cell liquid present in the cathode compartment in an ionized state. Where the hydroxyl portions of the caustic capable of approaching the anode in significant quantity, interferring cell reactions could occur evolving oxygen by-products and reducing the cell efficiency. Maintaining of a cell liquid level in the anode compartment somewhat greater than that in the cathode compartment causes a generally uniform movement of the cell liquid through the diaphragm into the cathode compartment. This fluid movement substantially reduces the tendency for dissolved sodium hydroxide hydroxyl radicals to migrate back through the diaphragm from the cathode compartment to the anode compartment causing deleterious cell reactions.

In a typical cell, the diaphragm is exposed to chlorine on one side, caustic on the other, and is bathed with brine on both sides. As may be readily imagined, there has been a challenge in developing materials suitably resistant to these harsh chemicals and thereby acceptable for use in preparing diaphragms for use in such chlorine cells.

Traditionally, diaphragms have been manufactured from asbestos. In a typical process, asbestos fibers are slurried in an electrolyte such as caustic or brine, and the asbestos fibers are deposited as a diaphragm. Purely asbestos diaphragms have long been somewhat unsatisfactory. Such diaphragms have tended to swell and bulge after a relatively short cell on stream period. Brief upsets in cell chemical operating conditions, particularly related to pH and electrical current, accelerate degradation of the diaphragm. Even brief interruptions in the cell electrical potential contribute to relatively rapid degradation of the diaphragm.

A variety of proposals have been proffered to improve the performance and reliability of cell diaphragms.

In one commercial proposal, cell diaphragms are deposited from slurries of various Teflon® fibers, TEFLON being a product of the E. I. duPont de Nemours & Company. While TEFLON diaphragms have demonstrated a significantly improved service life over asbestos diaphragms, a major disadvantage of such TEFLON diaphragms has been their considerable cost. Wettability difficulties also have been experienced with TEFLON diaphragms. These TEFLON diaphragms have tended to be less permeable to cations and a measurably greater liquid level differential between the anode and cathode compartments has long been required to assure adequate cell liquid movement through the diaphragm and to retain caustic primarily in the cathode compartment.

It has been proposed that multiple applications of a coating of zirconyl chloride would impart improve wettability characteristics to TEFLON diaphragms, U.S. Pat. Nos. 4,170,537, 4,170,538, and 4,170,539. In this proposal, each of several coating applications individually required hydrolyzation, leaching with ammonia, and dewatering of the diaphragm to provide sequentially build up layers of $ZrO_2$, the chemical agent attributed to enhanced wettability.

Various attempts have been made to combine asbestos and TEFLON fibers in producing diaphragms for use in chlorine cells. These attempts have met with difficulty in significant part again related to the cost of the TEFLON. Diaphragms fabricated with both TEFLON and asbestos have demonstrated improved reliability and dimensional stability over purely asbestos diaphragms.

More recently, it has been proposed that diaphragms deposited from asbestos fibers be saturated with an organic titanate, U.S. Pat. No. 4,180,449. Organic titanates saturating the diaphragm in this proposal are hydrolyzed and then pyrolyzed to yield combustion byproducts and a titanium oxide residue. Diaphragms treated with pyrolyzed organo titanates have been suggested to possess additional strength and durability when compared to identical purely asbestos diaphragms to which those organo titanates have not been applied.

Difficulties have arisen in the use of organo titanates for treating diaphragms. The proposed organo titanates usually are soluble only in nonaqueous solvents. Typically, these are organic solvents often made acidic and having an elevated vapor pressure that poses a potential flammability problem when used in a manufacturing environment.

The organo titanate saturating the diaphragm is pyrolyzed to convert contained titanium to $TiO_2$. An elevated temperature is required for this pyrolysis, often approaching 400° C. This elevated pyrolysis temperature can compound difficulties with flammable solvents.

Quantities of $TiO_2$ introduced into a diaphragm structure must be carefully monitored since $TiO_2$ present in a diaphragm in a quantity at least in excess of 5 percent by weight potentially can reduce permeability of the diaphragm significantly during various electrochemical cell operation.

DISCLOSURE OF THE INVENTION

The present invention provides an improved diaphragm and a process for producing the diaphragm from deposited fibers. The diaphragm of the invention possesses superior strength, improved dimensional stability under virtually all cell operating conditions when compared to conventional asbestos diaphragms and enhanced hydrophyllic characteristics.

A diaphragm made in accordance with the instant invention contains a zirconium compound that may be deposited either concurrently with the diaphragm in a multiple step process or separately. Where concurrent deposition is contemplated, a mixture of suitable or conventional fibers such as asbestos and/or other inorganic fibers as well as mixtures of such inorganic fibers with organically based fibers such as Teflon is slurried in an aqueous solution that includes a dissolved zirconium containing compound. The zirconium containing compound may be of a type requiring a somewhat acidic environment or may be of a type requiring a somewhat alkaline environment.

Where the zirconium compound requires an acidic environment, the slurry is maintained in a pH range of from 2 to 5. The slurry is passed through a porous surface. The fibers deposit upon the surface to form a diaphragm of relatively uniform thickness, the thickness being substantially a function of the quantity of slurry passing through the porous surface. Excess zirconium containing solution and water are withdrawn from the diaphragm. The diaphragm is heated to remove a substantial portion of remaining water and to convert a substantial portion of the zirconium containing compound to $ZrO_2$. During completion of the heating step, diaphragm temperatures will be in a range between 100° C. and 400° C.

Zirconium acetate is an example of a zirconium compound requiring an acid environment. Where zirconium acetate is utilized in the slurry, the slurry pH is controlled by additions of acetic acid or the like.

Where the zirconium compound is one requiring an alkaline environment, the slurry is maintained at a pH of between 7 and 11. This slurry is passed through a porous surface. The fibers are deposited upon the surface to form a diaphragm of relatively uniform thickness. Excess zirconium containing solution and water are withdrawn from the diaphragm. The diaphragm is heated to remove a substantial portion of remaining water and to convert a substantial portion of the zirconium containing compound to $ZrO_2$. During completion of the heating step, the diaphragm is heated to a temperature in the range of between 100° C. and 400° C.

Ammonium zirconium carbonate is an example of a suitable zirconium compound requiring an alkaline environment. Where ammonium zirconium carbonate is utilized in the slurry, the slurry pH can be controlled by the addition of compounds such as $(NH_4)_2CO_3$, $NH_4HCO_3$, $NaHCO_3$, $Na_2CO_3$, $KHCO_3$, $K_2CO_3$, NaOH, KOH, $NH_4OH$ or the like to the slurry.

As an alternate to depositing zirconium cocurrently with fibers constituting the diaphragm, the zirconium may be installed in the diaphragm following deposition of the fibers. As before, the zirconium binder can be deposited from either an aqueous solution of a zirconium compound requiring an acid environment or an aqueous solution of a zirconium compound requiring an alkaline environment. Both processes are begun by slurrying a mixture of fibers in a fluid. The slurry is passed through a porous surface to deposit the fibers as a diaphragm. Where a zirconium compound requiring an acidic environment is utilized, the diaphragm is saturated with a solution containing the zirconium compound, and the excess solution is removed. The diaphragm is at least partially dried and is heated to a temperature of between 100° C. and 400° C. to further dry the diaphragm and to convert zirconium contained in the drying diaphragm to $ZrO_2$.

Where the zirconium compound is one requiring an alkaline environment, subsequent to deposition, the diaphragm is washed with an alkaline solution to achieve a pH in the diaphragm of between 7 and 11. The diaphragm is thoroughly saturated with a solution containing the zirconium compound. Excess solution is then removed, and the diaphragm is at least partially dried and is heated to a temperature of between 100° C. and 400° C. to further dry the diaphragm and to convert zirconium contained in the drying diaphragm to $ZrO_2$.

The instant invention finds particular use in forming diaphragms from inorganic fibers such as asbestos or ceramic-like materials and the like. Where asbestos fibers constitute a significant portion of fibers to be used in forming the diaphragm, it is generally necessary to slurry the fibers in an electrolyte solution to obtain an acceptable slurry. In a typical chlorine cell house operation, the fibers are slurried either in an alkali metal halogen brine such as NaCl or KCl brine or in an alkali metal hydroxide solution such as NaOH or KOH or combinations of the aforementioned. Where electrolytes are utilized in slurrying the fibers, it may be advantageous to wash the diaphragm with water prior to saturating the diaphragm where an acidic zirconium compound is utilized, or prior to basic solution washing of the diaphragm where an alkali zirconium compound is utilized.

The invention may be utilized in strengthening and enhancing hydrophyllic properties of a previously produced diaphragm. Such a diaphragm is saturated with a zirconium containing solution, excess solution is removed, and the diaphragm is at least partially dried and heated to a temperature between 100° C. and 400° C. to pyrolyze zirconium remaining in the diaphragm to $ZrO_2$. The drying step is generally accompanied by heating.

A diaphragm made or treated in accordance with the instant invention includes a plurality of fibers randomly interwoven into a fibrous mat comprising the diaphragm. Interstices occur between fibers and a hydrophyllic strengthening binder of $ZrO_2$ coats the fibers and at least partially fills the interstices. The strengthening binder contributes to coadhering the fibers, resulting in a diaphragm that better retains its dimensional stability.

The above and other features and advantages of the invention will become apparent from the following detailed description of the invention forming a part of the specification.

BEST MODE FOR CARRYING OUT THE INVENTION

The present invention provides a diaphragm and a method for making the diaphragm for use in electrochemical cells. Particularly, the diaphragm is intended for use in cells disassociating alkali metal halide compounds in the production of halogens and particularly chlorine. The diaphragm of the instant invention offers extended electrochemical cell service life due to enhanced dimensional stability, strength, and hydrophyllic properties.

The diaphragm made in accordance with the instant invention is comprised of a plurality or multitude of fibers substantially and compactly randomly interwoven into a sheet or mat having generally a length and breadth dimension considerbly greater than its thickness. Interstices occur between the fibers within the mat, and these interstices are at least partially filled with a zirconium based compound believed to be of the form $ZrO_2$. The fibers, to a significant degree, are coated with the zirconium compound, and it is believed that the zirconium compound contributes to binding between the fibers thus increasing the strength and dimensional stability of the diaphragm.

The fibers may be of any suitable or conventional type. The invention accomplishes particularly favorable results when essentially inorganic fibers comprise a substantial portion of the fibers deposited as a diaphragm. Inorganic fibers are particularly amenable to the benefits derived from using the invention.

The fibers are preferably of more than a single relatively uniform length. It is preferred that fibers of at least two significantly different lengths be utilized in preparing a diaphragm.

The diaphragm may be fabricated by depositing the fibers and the zirconium compound cocurrently as a diaphragm or by depositing the fibers as a diaphragm and then subsequently introducing the zirconium compound into the diaphragm. In that way, diaphragms previously fabricated can be strengthened and dimensionally stabilized as subsequent needs develop.

Fibrous diaphragms are deposited generally by passing or drawing a slurry of the fibers through a porous surface. Fibers are often received in a dry form, and slurrying the fibers in a fluid separates or "spreads" the fibers to enhance fiber deposition. The separated fibers, it has been found, are more easily deposited in a desired randomly interwoven pattern in the diaphragm.

Methods for slurrying such inorganic fibers as asbestos and various organic fibers are well known, and any suitable or conventional method will suffice. When spreading at least asbestos fibers, it is generally recognized that an improved fiber slurry process is obtained where the fluid contains a suitable or conventional dissolved electrolyte. While a substantial number of suitable electrolytes are available, it has been the practice generally to use electrolytes commonly available in the surrounding electrochemical process. So in electrochemical disassociation of sodium chloride, a sodium chloride brine or a solution of sodium hydroxide or a mixture thereof has been utilized to slurry the fibers where the fibers include a significant proportion of asbestos. Where potassium chloride is utilized in an electrochemical disassociation cell, frequently a potassium chloride brine or a potassium hydroxide solution is utilized in slurrying the fibers. Similarly in other electrochemical disassociation processes utilizing other alkali metal halogen compounds, a brine of the alkali metal halogen or a solution of the alkali metal hydroxide may be used in slurrying the fibers used to deposit the diaphragm. Alternately, where the zirconium containing compound is an electrolyte, the compound may be used in lieu of or in addition to other electrolytes in slurrying the fibers.

Where alkali metal halide brines are used in slurrying fibers, it has been found advantageous to utilize an aqueous brine in an alkali metal halide concentration range of between 5 percent of saturation and saturation. Preferably, the aqueous brine will be in a concentration range of between 20 percent of saturation and 40 percent of saturation.

Where an alkali metal hydroxide solution is utilized in slurrying the fibers, it has been found advantageous to utilize an aqueous solution of the alkali metal hydroxide in a concentration range of between 4 weight percent and 50 weight percent. Preferably, the aqueous solution will be in a concentration range of between 4 weight percent and 20 weight percent. Other suitable or conventional electrolytes are entirely within the scope of the invention.

Where the zirconium containing compound is slurried with fibers for codeposition as a diaphragm, the use of other electrolytes, particularly in slurrying asbestos, may not be required. A large variety of zirconium containing compounds have been identified as suitable for use in the instant invention. Among those suitable compounds are $ZrO(OH)_2$, $Zr(NO_3)_4$, $ZrOSO_4$, zirconium pyrophosphate, and zirconium oxylate, as well as zirconium acetate and ammonium zirconium carbonate. These latter two have been identified as particularly useful in implementing the invention.

Zirconium compounds cocurrently deposited with the fibers in a diaphragm are first dissolved into solution containing between 5 weight percent and 50 weight percent of the zirconium compound and preferably between 5 weight percent and 35 weight percent. The solution is combined with the fibers in a suitable or conventional manner to produce the slurry. The percentage of zirconium present in the various suitable zirconium containing compounds varies. Therefore, the solution concentration of zirconium compound varies within the concentration range as the various compounds are utilized.

One preferred zirconium compound, zirconium acetate, is better utilized in slightly acidic solutions. Where fibers are to be slurried in a zirconium acetate containing solution, the pH of the solution is preferably maintained between a pH of between about 2 and about 5. pH adjustment can be accomplished by the addition of a suitable or conventional acid such as acetic acid or the like.

Another preferred zirconium compound, ammonium zirconium carbonate is better utilized in an alkaline solution environment. Where fibers are to be slurried in a zirconium solution utilizing ammonium zirconium carbonate, the solution is preferably maintained in a pH range of between 7 and 11. pH adjustments can be accomplished in any suitable or conventional manner such as by the addition of a basic compound such as $(NH_4)_2CO_3$, $Na_2CO_3$, $NaHCO_3$, $K_2CO_3$, $KHCO_3$, $H_4NOH$, NaOH and KOH or the like.

The slurry, whether containing the zirconium compound or not, is deposited as a diaphragm by passing or drawing the slurry through a porous surface. The porous surface contains a plurality of apertures permitting passage of much of the solution but of a size and spacing whereby a substantial portion of the fibers are retained upon the porous surface. These retained fibers deposit on the surface in an essentially random fashion producing a random interweaving of the fibers into a relatively dense fibrous mat. As might be expected, interstices occur between many of the fibers within the mat. Utilization of fibers of more than a single length enhances the random fiber interweaving as fibers deposit.

The porous surface upon which the fibers are deposited is preferably a cathode utilized in the electrochemical cell. Following completion of fiber deposition and treatment to convert the zirconium compound, the cathode, with the diaphragm, can be stored pending future needs when the diaphragm and cathode together are installed in the electrochemical cell. Alternately, the diaphragm can be deposited on a surface having the size and shape of a cathode, removed following treatment to convert the zirconium compound, the later installed on an electrochemical cell cathode. Depositing directly on a cathode is substantially preferred.

A number of methods are known for passing the slurry through the porous surface. The preferred method is to draw the slurry by imposing a partial vacuum obverse to the porous surface on which the diaphragm is being deposited.

Flow of slurry through the porous surface is stopped when the diaphragm has reached a desired thickness. After the diaphragm has been deposited, where the slurry has contained the zirconium compound, the diaphragm is treated to convert the zirconium compound.

Excess zirconium solution remaining in the diaphragm is removed by vacuum or the like. A substantial portion of excess zirconium compound solvent remaining in the diaphragm is then removed. Usually this solvent is water, and it is preferred that this water be removed by simple drying. The drying may be accompanied by an elevation in temperature, but the temperature elevation should not exceed the boiling point of the solvent carrying the zirconium compound. In the preferred embodiment, this solvent is water, and the drying temperature should preferably not exceed 100° C. Exceeding the boiling point of the solvent during drying may blister and spall the deposited diaphragm.

Following drying, the diaphragm is elevated to a temperature between 100° C. and 400° C. At this elevated temperature, the diaphragm dries further, and the zirconium containing compound is converted to $ZrO_2$. The elevated temperature is continued until a substantial proportion of the zirconium containing compound has been converted.

The $ZrO_2$ coats the fibers of the diaphragm and at least partially fills the interstices between fibers. A diaphragm containing the coated fibers displays an elevated tendency to retain dimensional stability. The stability is manifested by an increased service life in an electrochemical cell environment and increased resistance to changes in cell operating condition.

Zirconium treated diaphragms, it has been found, generally require a lower liquid head differential between cathode and anode compartments in transferring a given amount of cell liquid between the compartments. The $ZrO_2$ coating the diaphragm fibers appears to impart enhanced hydrophyllic properties to the diaphragm facilitating cell liquor movement therethrough. These diaphragms also exhibit enhanced strength and resistance to damage during cell power outages, cell pH upsets and cell liquor flow outages.

Where a diaphragm is not deposited from a slurry containing a zirconium compound, it is necessary to treat the diaphragm subsequently with a zirconium containing solution. Generally the diaphragm is saturated with a solution containing the zirconium compound. The solution may be in the same range of zirconium compound concentration as zirconium containing solutions used to slurry fibers for deposition, that is in a range of between 5 weight percent and 50 weight percent and preferably between about 5 weight percent and 35 weight percent. Where ammonium zirconium carbonate is used as the zirconium compound for treatment after deposition, it has been found that a solution concentration of between 3 weight percent and 50 weight percent produces a satisfactory single application treatment for a diaphragm.

Excess solution is removed from the saturated diaphragm by a suitable or conventional method such as by vacuum. The diaphragm is dried at a temperature below the boiling point of the solvent utilized in preparing the zirconium compound solution. In the preferred embodiment of the invention, the solvent is water and that temperature, as before, is 100° C. or less. After drying to remove a substantial portion of water remaining in the diaphragm, the diaphragm is heated to a temperature between 100° C. and 400° C. at least until a substantial portion of the zirconium compound is converted to the form $ZrO_2$.

In preferred embodiments, only a single aqueous solution treatment of a diaphragm is necessary to achieve a strengthened, dimensionally more stable diaphragm using solutions of the strength described. By multiple application of a weaker zirconium containing solution, it is possible to obtain the stronger more dimensionally stable diaphragm of the present invention, and such multiple applications are within the contemplation of this invention. However, the preferred embodiment provides for a single aqueous solution application as providing expediency, safety and efficiency in preparing the diaphragm.

Where diaphragms are to be treated with a zirconium containing solution in accordance with the invention after being deposited from slurry prepared with an electrolyte other than a zirconium compound, residual amounts of that electrolyte may interfere with functioning of the zirconium compound. Zirconium acetate and zirconium ammonium carbonate are particularly sensitive to residual electrolyte in the diaphragm. These compounds require a restricted pH range in order to function effectively, and residual electrolyte on the diaphragm must, therefore, be removed where a significant interference potential exists.

For zirconium acetate, a simple washing of the diaphragm prior to saturation of the diaphragm with a zirconium acetate solution will usually suffice to remove undesirable residual electrolyte from the diaphragm. For the zirconium acetate to function effectively, it is necessary that the zirconium acetate solution be maintained in a pH range of between 2 and 5. Maintenance of pH may be accomplished by the addition of any suitable or conventional acid such as acetic acid or the like.

For ammonium zirconium carbonate, it has been found that washing of the diaphragm with an aqueous solution of a weakly alkaline electrolyte such as $(NH_4)_2CO_3$, $NH_4OH$, $Na_2CO_3$, $NaHCO_3$, $K_2CO_3$, $KHCO_3$ and $NH_4HCO_3$ or the like is usually necessary. The washing solution preferably should be maintained in a pH range of between 7 and 11 by adjustment of the quantity of an alkaline electrolyte present in the solution. Likewise, the pH of the ammonium zirconium carbonate solution utilized in saturating the diaphragm should be maintained in a range of between 7 and 11 by the controlled addition of any of the same electrolytes, and preferably by the controlled addition of $(NH_4)_2CO_3$. In addition, where the electrolyte utilized in slurrying the diaphragm fibers is a strong alkali such as NaOH or a neutral ion salt such as NaCl, at least one water wash of the diaphragm is preferable prior to washing with the solution of the mildly alkaline electrolyte. A substantial quantity of washing water may be required where a relatively large concentration of electrolyte was utilized in preparing the slurry.

The following examples are offered to illustrate further the features and advantages of the invention.

These examples were obtained using a bench scale chlorine diaphragm cell. The cell included a steel mesh cathode formed from 0.093 inch steel wire calendered to a thickness of 0.155 inch and arranged in a 6×6 mesh. This cathode was separated from the anode in the cell by a distance of ½ inch. The cell anode was a circular titanium mesh of $\pi$ square inch coated with a Diamond Shamrock DSA-CX® type coating. The DSA-CX® coating, a Diamond Shamrock product, contains tin, ruthenium and titanium oxides as shown and described in U.S. Pat. No. 3,776,834.

During operation of the bench cell while testing diaphragms for performance characteristics, a purified sodium chloride brine in a concentration of about 300 grams per liter and at a pH of 2 was fed into the anolyte chamber of the cell. The liquid level of the brine in the anolyte chamber was maintained at between 0 and 18 inches above the liquid level in the cathode chamber. The liquid head in the anode chamber was varied as required to maintain both a sodium hydroxide concentration of between 125 and 140 grams per liter in catholyte exiting the cathode chamber and an acceptable movement rate of cell liquor through the diaphragm. In all examples, the cell was operated at 1.0 amps per square inch current density, and at about 90° C. or greater, maintained using a heater.

Diaphragms, in the examples, were deposited by first applying a vacuum at the cathode screen and then pouring a slurry of the diaphragm fiber to be deposited over the cathode screen surface subject to the vacuum so that the slurry liquor would be drawn through the screen by the vacuum and the fibers deposited on the screen as a diaphragm. Saturation of the diaphragm with zirconium containing solutions in most cases was accomplished by pouring those solutions through a funnel onto the diaphragm and pulling the solution through the diaphragm utilizing vacuum applied to the cathode in a procedure well known to those skilled in the art. In a few cases, the diaphragm and cathode screen were immersed in the solution which was then circulated through the diaphragm. Where diaphragms were washed, washing liquid was removed utilizing the vacuum.

EXAMPLE 1

A zirconium containing solution was formed by dissolving 481 grams of zirconium acetate in 2,405 milliliters of water. The solution was combined with 31 grams of #2 Vermont Asbestos Group (VAG) short asbestos fibers and 15.5 grams of #1 VAG long asbestos fibers, and the resultant mixture was thoroughly agitated to spread the asbestos fibers thereby forming a slurry of the asbestos in the solution. The resulting slurry was aged for 21 days. A portion of the slurry was then deposited as a diaphragm on the cathode, the resulting diaphragm being of a mat density of 1.10 grams per square inch. This diaphragm was heated to 100° C. for 2 hours and then baked at 360° C. for 2 hours. The diaphragm was then installed in the bench scale chlorine diaphragm cell and operated continuously for 155 days. During this operation, this cell voltage averaged 2.96 volts, the liquid level in the anode compartment averaged 4.75 inches above the liquid level in the cathode compartment, and catholyte exiting the cathode compartment contained approximately 135 grams per liter NaOH. The cell experienced an 89 percent current efficiency. After 155 days, no significant disintegration of the diaphragm could be detected upon inspection, nor had performance characteristics of the cell inclined measurably.

EXAMPLE 2

A zirconium containing solution was prepared by disolving 249 grams of zirconium acetate in 2,489 milliliters of water. The solution was combined with 31.0 grams of #2 VAG short asbestos fibers and 15.5 grams of #1 VAG long asbestos fibers. The resulting mixture was agitated thoroughly to spread the asbestos fibers and form a slurry. This slurry was aged for 3 days and was deposited on the bench scale chlorine diaphragm cell cathode. This diaphragm was heated to 100° C. and maintained at 100° C. for 2 hours. The diaphragm was then baked at 360° C. for an additional 2 hours resulting in a mat having a density of 1.10 grams per square inch. The diaphragm was installed in the bench scale chlorine diaphragm test cell for 155 days during which time the averaged cell voltage was 3.07 volts, the liquid level in the anode chamber averaged 10.5 inches above the liquid level in the cathode chamber and catholyte exiting the cathode chamber contained approximately 130 grams per liter of NaOH. The cell operated at 93.1 percent current efficiency; and after 155 days, no significant disintegration of the diaphragm could be observed upon inspection, and no significant decrease in cell performance characteristics were observed.

EXAMPLE 3

A zirconium containing solution was prepared by dissolving 1,089 grams of zirconium acetate in 2,179 grams of water. The resulting solution was combined with 34 grams of #2 VAG short asbestos fibers and 17 grams of #1 VAG long asbestos fibers. The resulting mixture was agitated to spread the asbestos fibers and form a slurry. The resulting slurry was aged for 13 days. The slurry was then deposited as a diaphragm on the cathode of the bench scale chlorine diaphragm test cell. The resulting diaphragm was heated to 100° C. for 2 hours and then baked at 400° C. for 2 hours resulting in a diaphragm having a mat density of 1.125 grams per square inch. The diaphragm was then installed in the bench scale chlorine diaphragm test cell for 50 days during which time the cell operated at 2.97 volts, with a head differential between the anode and the cathode compartments of 6.5 inches and with the catholyte exiting the cathode compartment containing approximately 130 grams per liter NaOH. The cell experienced a current efficiency of 89.8 percent; and after 50 days, no appreciable deterioration in the diaphragm could be detected upon inspection, nor had any significant decrease in the cell performance characteristics occurred.

EXAMPLE 4

A zirconium containing solution was prepared by dissolving 973 grams of zirconium acetate in 1,945 milliliters of water. The solution was combined with 30 grams of #2 VAG short asbestos fibers and 15 grams of #1 VAG long asbestos fibers. The resulting mixture was agitated to spread the asbestos fibers and to form a slurry. The resulting slurry was not aged but was immediately deposited onto the cathode of the bench scale chlorine diaphragm test cell. The diaphragm was heated to 100° C. for 2 hours and then baked at 400° C. for 2 hours resulting in a diaphragm having a mat having density of 1.0 gram per square inch. The diaphragm was then installed in the bench scale chlorine diaphragm test cell for 131 days during which time the cell operated at a voltage of 2.87 volts, with a head differential between the anode and the cathode compartments of 6 inches and with the catholyte exiting the cathode chamber containing approximately 130 grams per liter NaOH. The cell operated at a 93 percent current efficiency; and when removed for inspection, the diaphragm showed no significant physical deterioration. During its operation, the cell experienced no significant decrease in cell performance characteristics.

EXAMPLE 5

A solution was prepared containing 2 grams of anhydrous ammonium carbonate, 167 milliliters of ammonium zirconium carbonate, and sufficient water to make up one liter of solution, approximately 833 milliliters of water. The solution was combined with 12 grams of #2 VAG short asbestos fibers and 6 grams of #1 VAG long asbestos fibers. The mixture was agitated to spread the asbestos fibers and to form a slurry. The resulting slurry, having a pH of 9.5, was aged for 8 days. Approximately 300 milliliters of the slurry was deposited as a diaphragm on the bench scale chlorine diaphragm cell cathode. The diaphragm was heated at 110° C. for approximately 2 hours and then further heated at 220° C. for an additional 2 hours. The resulting diaphragm had a mat density of approximately 0.90 gram per square inch. The diaphragm was installed in the bench scale chlorine diaphragm test cell for 45 days. The cell voltage during this period was approximately 3.06 volts, with a head differential between anode and cathode compartments of approximately 1.5 inches, and with the catholyte exiting the cathode compartment containing approximately 131 grams per liter NaOH. The cell current efficiency as 91.2 percent; and at the conclusion of the run, upon inspection, no significant physical deterioration in the diaphragm could be detected nor had any significant decrease in cell performance occurred.

EXAMPLE 6

A zirconium containing solution was prepared by dissolving 100 grams of ammonium carbonate and 333 milliliters of ammonium zirconium carbonate in sufficient water, approximately 1,600 milliliters, to make 2 liters of solution of a pH of about 9.5. This solution was combined with 24 grams of #2 VAG short asbestos fibers and 12 grams of #1 VAG long asbestos fibers. The resulting mixture was agitated to spread the asbestos fibers and to form a slurry. The resulting slurry was aged 5 days, and approximately 270 milliliters of the slurry was deposited as a diaphragm on the bench scale chlorine diaphragm test cell cathode. The diaphragm was heated to 45° C. for 16 hours and then further heated to 220° C. for one hour. The mat density of the resulting diaphragm was 0.93 gram per square inch. This diaphragm was installed in a bench scale chlorine diaphragm test cell for 4 days during which time the cell was operated at 3.03 volts, the head differential between the anode and cathode compartments was 6.75 inches, and catholyte exiting the cathode compartment contained approximately 136.6 grams per liter of NaOH. The cell operated at a current efficiency of 91.7 percent; and upon completion of the run, no significant physical deterioration of the diaphragm was observed nor had cell operating conditions significantly deteriorated.

EXAMPLE 7

A zirconium containing solution was prepared by dissolving 54 milliliters of ammonium zirconium carbonate in 216 milliliters of water. The solution was combined with 3.24 grams of #2 VAG short asbestos fibers and 1.62 grams of #1 long asbestos fibers. The mixture was agitated to spread the asbestos fibers and to form a slurry. The resulting slurry was aged for 4 days and then deposited as a diaphragm on the cathode of the bench scale chlorine diaphragm test cell. The diaphragm was heated to 100° C. for one hour and then to 220° C. for one hour. The mat density of the resulting diaphragm was 0.90 gram per square inch. The diaphragm was installed in the bench scale chlorine diaphragm test cell fo 41 days during which time the cell operated at 3.04 volts, with a head differential between the anode and the cathode compartments of 2½ inches and with the exiting catholyte from the cathode chamber containing 130 grams per liter of NaOH. The current efficiency of the cell during this period of operation was 91.2 percent; and at the conclusion of the run, no significant diaphragm deterioration was apparent nor had cell operating conditions declined significantly.

EXAMPLE 8

A slurry was formed by combining 500 milliliters of 100-gram per liter caustic solution, 500 milliliters of 200-gram per liter ammonium carbonate solution, 12 grams of #2 VAG short asbestos fibers and 6 grams of #1 VAG long asbestos fibers. The resulting mixture was agitated to spread the asbestos fibers and form a slurry having a pH of 9.8. The slurry was aged for one day, after which approximately 300 milliliters of the slurry was deposited on the cathode of the bench scale chlorine diaphragm test cell. The diaphragm was washed with approximately 25 milliliters of water and then washed with approximately 25 milliliters of a 100-gram per liter aqueous solution of ammonium carbonate. The diaphragm was then thoroughly saturated with a zirconium containing solution comprised of one part ammonium zirconium carbonate and 5 parts of a 40-gram per liter solution of ammonium carbonate. The treated diaphragm was heated at 95° C. for one hour and then at 220° C. for one hour resulting in a diaphragm having a mat density of 1.22 grams per square inch. The diaphragm was then installed on the chlorine diaphragm test cell for 28 days during which time the cell voltage was 3.08 volts, the head differential between anode and cathode compartments was approximately 2 inches, and catholyte exiting the cathode chamber contained approximately 131 grams per liter of NaOH. The cell operated at a 92 percent current efficiency; and at the completion of the run, no significant physical deterioration to the diaphragm was observed, and the cell operating parameters had not significantly declined.

EXAMPLE 9

Approximately 300 milliliters of the slurry formed in Example 8 was aged for 5 days and deposited on the cathode of the bench scale chlorine diaphragm test cell. This diaphragm was washed with approximately 25 milliliters of water and then washed with approximately 25 milliliters of an aqueous ammonium carbonate solution containing 100 grams per liter of ammonium carbonate. The diaphragm was then thoroughly saturated with a zirconium containing solution formed by combining one part of ammonium zirconium carbonate with 5 parts of a 40-gram per liter aqueous solution of ammonium carbonate. The treated diaphragm was heated at 100° C. for one hour and then 180° C. for one hour yielding a diaphragm with a mat density of 1.06 grams per square inch. The treated diaphragm was installed in the chlorine diaphragm test cell. The test cell was operated utilizing this diaphragm for 57 days during which time the cell voltage was 3.02 volts, the head differential between anode and cathode compartments was 3.25 inches, and catholyte exiting the cathode chamber contained approximately 130 grams of NaOH per liter. The current efficiency of the cell during this run was 92.9 percent; and at the completion of the run, no significant physical deterioration to the diaphragm could be observed, and there was no significant decline in cell operating parameters.

EXAMPLE 10

A mixture of 100 grams ammonium carbonate, 12 grams of #2 VAG short asbestos fibers, 6 grams of #1 VAG long asbestos fibers, and sufficient water, approximately 1,000 milliliters to complete a volume of one liter was agitated to spread the asbestos fibers thereby forming a slurry. The slurry was aged for 11 days. Approximately 300 milliliters of the slurry was deposited on the cathode of the bench scale chlorine diaphragm test cell. The diaphragm was washed with approximately 25 milliliters of water and then washed with approximately 25 milliliters of an aqueous ammonium carbonate solution containing 100 grams per liter of ammonium carbonate. The diaphragm was then thoroughly saturated with a zirconium containing solution containing one part ammonium zirconium carbonate and 5 parts of a 40-gram per liter aqueous ammonium carbonate solution. Excess zirconium containing solution was removed under vacuum. The treated diaphragm was then heated at 85° C. for 45 minutes and further heated at 180° C. for approximately 16 hours to yield a diaphragm having a mat density of 0.88 gram per square inch. The resulting diaphragm was installed on the bench scale chlorine diaphragm test cell for 26 days during which time the cell operated at 3.03 volts, with a head differential between anode and cathode compartments of 2 inches, and with catholyte exiting cathode chamber containing approximately 130 grams per liter of caustic. During this operation, the cell current efficiency was 91.6 percent; and at the completion of the run, inspection of the diaphragm did not reveal significant deterioration, and no appreciable reduction in cell operating parameters had occurred.

EXAMPLE 11

A mixture of 100 grams of ammonium carbonate, 9 grams of #2 VAG short asbestos fibers, 9 grams of #1 VAG long asbestos fibers, and sufficient water, approximately 1,000 milliliters to constitute a mixture volume of one liter was subjected to agitation to spread the abestos fibers and form a slurry. The pH of the resulting slurry was 9.1. Approximately 270 milliliters of the slurry was deposited on the cathode of the bench scale chlorine diaphragm test cell without aging. The resulting diaphragm was washed with approximately 25 milliliters of water and then washed with approximately 25 milliliters of a 100-gram per liter aqueous solution of ammonium carbonate. The diaphragm was then thoroughly saturated with a zirconium containing solution containing one part ammonium zirconium carbonate and 10 parts of a 40-gram per liter ammonium carbonate solution. Excess zirconium containing solution was evacuated by vacuum, and the diaphragm was then heated to 85° C. for one hour and then to 250° C. for one hour. The resulting diaphragm had a mat density of 0.90 grams per square inch and was installed in the bench scale chlorine diaphragm test cell for 82 days. While the diaphragm was installed on the test cell, the test cell operated at 2.99 volts, with a head differential between anode and cathode compartments of 1.5 inches, and with catholyte exiting the cathode chamber containing approximately 131 grams of NaOH per liter. During operation of the test cell, the cell current efficiency was 92.1 percent; and at the completion of the run, no significant physical deterioration of the diaphragm could be observed, nor had operating parameters of the cells significantly declined.

EXAMPLE 12

36 grams of #2 VAG short asbestos fibers and 18 grams of #1 VAG long asbestos fibers were added to 3 liters of a chlorine cell liquid containing 130 grams per liter of NaOH and 180 grams per liter of NaCl. The mixture was agitated to spread the asbestos fibers and then aged for 16 days. Approximately 300 milliliters of the slurry was deposited on the cathode of the bench scale chlorine diaphragm test cell. The deposited diaphragm was washed twice with 25 milliliters of water and then once with approximately 25 milliliters of a 100-gram per liter solution of ammonium carbonate. The diaphragm was then soaked with 100 grams per liter of ammonium carbonate solution for 10 minutes, and the solution was evacuated under vacuum. The diaphragm was then saturated with a zirconium containing solution containing one part ammonium zirconium carbonate and 3 parts of a 40-gram per liter ammonium carbonate aqueous solution. The excess solution was evacuated under vacuum. The diaphragm was dried for 30 minutes at ambient temperature, heated to 90° C. and dried under vacuum for 30 minutes and then further heated to 220° C. for one hour. The mat density of the resulting diaphragm was 1.0 gram per square inch. The diaphragm was installed on the bench scale chlorine diaphragm test cell for 56 days during which time the cell operated at 2.97 volts with a brine head differential between the anode and cathode compartments of 7.5 inches, while producing catholyte containing 136 grams per liter of NaOH. The cell operated at a 90 percent current efficiency; and at the completion of the run, examination of the diaphragm indicated no significant physical deterioration, nor had operating parameters of the cell significantly declined.

EXAMPLE 13

A mixture of 100 grams of sodium chloride, 9 grams of #2 VAG short asbestos fibers, 9 grams of #1 VAG long asbestos fibers, and sufficient water, approximately 1,000 milliliters, to form one liter of the mixture was agitated to spread the asbestos fibers thereby forming a slurry. The slurry was aged for 5 days following which time 270 milliliters of the slurry was deposited on the cathode of the bench scale chlorine diaphragm test cell. The deposited diaphragm was then washed with approximately 25 milliliters of water, washed again with approximately 25 milliliters of water, and then soaked with 100 grams per liter of aqueous ammonium carbonate solution for 10 minutes. The ammonium carbonate solution was evacuated under vacuum, and the diaphragm was saturated with zirconium containing solution containing one part ammonium zirconium carbonate and 3 parts of 40 grams per liter of aqueous ammonium carbonate solution. Excess solution was then evacuated from the diaphragm under vacuum, the diaphragm was dried under vacuum at ambient temperatures for 15 minutes, dried at 100° C. for one hour and heated to 220° C. for one hour. The diaphragm was installed on the bench scale chlorine diaphragm test cell for 14 days during which time the test cell operated at 2.98 volts with a brine head differential between the anode and cathode compartments of 2.25 inches, while producing catholyte containing approximately 130 grams per liter of sodium hydroxide. The cell operated at a 90 percent current efficiency; and at the completion of the run, inspection of the diaphragm did not indicate any significant physical deterioration, and no decline in cell operating parameters was observed.

While a preferred embodiment of the invention has been described in detail and shown in the examples, it will be apparent that various modifications or alterations may be made therein without departing from the spirit and scope of the invention set forth in the appended claims. Particularly, it may be seen that though an efficient one-time treatment procedure is described whereby the strengthening compound $ZrO_2$ is impregnated into a diaphragm by a single treatment with a zirconium containing solution, similar results may be accomplished through multiple treatments with zirconium containing solutions.

What is claimed is:

1. A method for making a porous asbestos diaphragm for use in an electrochemical process including the steps of:
   (1) slurrying a mixture of fibers including primarily asbestos fibers in an aqueous solution of at least one of NaCl within a concentration range of from about 5 percent of saturation to about 50 percent of saturation and NaOH within a concentration range of from about 4 weight percent to about 50 weight percent;
   (2) drawing the slurry through a porous surface;
   (3) depositing the fibers upon the porous surface to a desired thickness;
   (4) drawing a substantial quantity of wash water through the diaphragm;
   (5) dissolving a basic compound selected from a group consisting of $(NH_4)_2CO_3$, $NH_4OH$, $KHCO_3$, $K_2CO_3$, $Na_2CO_3$, $NaHCO_3$, weak caustic and brine in water to form a basic solution;
   (6) drawing the basic solution through the diaphragm at least until a pH of between 7 and 11 is achieved generally uniformly throughout the diaphragm,
   (7) drawing an aqueous solution of ammonium zirconium carbonate within a range of concentration of between about 3 weight percent and about 50 weight percent through the diaphragm to thoroughly saturate the diaphragm;
   (8) withdrawing excess ammonium zirconium carbonate solution from the diaphragm;
   (9) heating the diaphragm to remove a substantial portion of water remaining in the diaphragm; and
   (10) further heating the diaphragm to between 110° C. and 400° C. to remove further moisture and to oxidize the ammonium zirconium carbonate to $ZrO_2$ and combustion by-products.

2. The method of claim 1 wherein the fibers are slurried in an aqueous solution including NaCl within a concentration range of from about 20 percent of saturation to about 40 percent of saturation.

3. The method of claim 1 wherein the fibers are slurried in an aqueous solution including NaOH within a concentration range of from about 4 weight percent to about 20 weight percent.

4. The method of claim 1 wherein the aqueous solution of ammonium zirconium carbonate lies within a range of concentration of between about 5 weight percent and about 35 weight percent.

5. A method for making a porous asbestos diaphragm for use in an electrochemical process including the steps of:

(1) slurrying a mixture of fibers including primarily asbestos fibers in an aqueous solution of at least one of NaCl within an NaCl concentration range of from about 5 percent of saturation to about 50 percent of saturation and NaOH within an NaOH concentration range of from about 4 weight percent to about 50 weight percent;
(2) drawing the slurry through a porous surface;
(3) depositing the fibers upon the porous surface to a desired thickness;
(4) drawing a substantial quantity of wash water through the diaphragm;
(5) drawing an aqueous solution of zirconium acetate within a range of concentration of between about 3 weight percent to about 50 weight percent through the diaphragm to thoroughly saturate the diaphragm;
(6) withdrawing excess zirconium acetate solution from the diaphragm;
(7) heating the diaphragm to remove a substantial portion of water remaining in the diaphragm; and
(8) further heating the diaphragm to between 100° C. and 400° C. to remove further moisture and to oxidize the zirconium acetate to $ZrO_2$ and combustion by-products.

6. The method of claim 5 wherein the fibers are slurried in an aqueous solution including NaCl within a NaCl concentration range of from about 20 percent of saturation to about 40 percent of saturation.

7. The method of claim 5 wherein the fibers are slurried in an aqueous solution including NaOH within an NaOH concentration range of from about 4 weight percent to about 20 weight percent.

8. The method of claim 5 wherein the aqueous solution of zirconium acetate lies within a range of concentration of between about 5 weight percent to about 35 weight percent.

9. A method for making a porous diaphragm for use in an electrochemical process comprising the steps of:

(1) slurrying a mixture of substantially asbestos fibers in an aqueous solution containing zirconium acetate in a composition range of between about 5 percent and 50 weight percent;
(2) maintaining a slurry pH of not less than 2 nor more than 5;
(3) passing the slurry through a porous surface to deposit the fibers upon the porous surface to a desired thickness;
(4) withdrawing excess zirconium containing solution from the diaphragm;
(5) removing a substantial portion of water remaining in the diaphragm; and
(6) heating the diaphragm to between 100° C. and 400° C. to remove additional moisture and to convert a substantial portion of the zirconium compound to $ZrO_2$.

10. The method of claim 9 wherein the zirconium acetate containing solution is comprised of zirconium acetate in a composition range of between about 5 weight percent and 35 weight percent.

11. A method for making a porous diaphragm for use in an electrochemical process comprising the steps of:

(1) slurrying a mixture of substantially asbestos fibers in an aqueous solution containing ammonium zirconium carbonate in a composition range of between about 5 weight percent and 50 weight percent;
(2) maintaining a slurry pH of not less than 7 nor more than 11 by adding a basic compound selected from the group consisting of $(NH_4)_2CO_3$, $NH_4OH$, $NaHCO_3$, $Na_2CO_3$, $NH_4HCO_3$, $K_2CO_3$ and $KHCO_3$ to the slurry;
(3) passing the slurry through a porous surface to deposit the fibers upon the porous surface to a desired thickness;
(4) withdrawing excess zirconium containing solution from the diaphragm;
(5) removing a substantial portion of water remaining in the diaphragm; and
(6) further heating the diaphragm to between 100° C. and 400° C. to remove additional moisture and to convert the zirconium containing compound to $ZrO_2$.

12. A method for preparing a diaphragm for use in an electrochemical cell, the diaphragm consisting essentially of inorganic asbestos fibers, comprising the steps of:

(1) slurrying a quantity of said fibers in an aqueous solution containing zirconium acetate in a concentration range of between 5 weight percent and 35 weight percent;
(2) maintaining a slurry pH of between 2 and 5 by introducing required quantities of an acid into the slurry;
(3) drawing the slurry through a porous surface to deposit the fibers upon the porous surface to a desired thickness thereby forming the diaphragm;
(4) withdrawing excess solution containing the zirconium compound from the diaphragm; and
(5) heating the diaphragm to remove water remaining in the diaphragm and to convert zirconium remaining in the diaphragm to $ZrO_2$.

13. The method of claim 12 including the step of further heating the diaphragm at a higher temperature within a range of 100° C. to 400° C. to accelerate drying of the diaphragm and conversion of the zirconium compound.

14. A process for preparing a diaphragm for use in an electrochemical cell, the diaphragm consisting essentially of inorganic fibers, comprising the steps of:

(1) slurrying a quantity of said fibers in an aqueous solution containing ammonium zirconium carbonate present in the solution in a concentration range of between 5 weight percent and 35 weight percent;
(2) maintaining a slurry pH of between 7 and 11 by addition of basic compounds selected from a group consisting of $(NH_4)_2CO_3$, $(NH_4)OH$, $NH_4CHO_3$, $Na_2CO_3$, $K_2CO_3$ and $KHCO_3$;
(3) drawing the slurry through a porous surface to deposit the fibers upon the porous surface to a desired thicknss thereby forming the diaphragm;
(4) withdrawing excess solution containing the zirconium compound from the diaphragm; and
(5) heating the diaphragm to remove water remaining in the diaphragm and to convert zirconium remaining on the diaphragm to $ZrO_2$.

15. The method of claim 14 including the step of further heating the diaphragm at a higher temperature within a range of from 100° C. to 400° C. to accelerate drying of the diaphragm and conversion of the zirconium compound.

* * * * *